US005769769A

United States Patent [19]

Torntore

[11] Patent Number: 5,769,769

[45] Date of Patent: Jun. 23, 1998

[54] POSITIONABLE POWER PAINT ROLLER WITH EDGER DEVICE

[75] Inventor: Anthony J. Torntore, Bloomington, Minn.

[73] Assignee: Wagner Spray Tech Corporation, Minneapolis, Minn.

[21] Appl. No.: 630,117

[22] Filed: Apr. 8, 1996

[51] Int. Cl.[6] ..... B05C 17/02; B05C 1/10

[52] U.S. Cl. ..... 492/13; 401/197; 15/230.11; 15/144.1

[58] Field of Search ..... 15/230.11, 144.1; D4/122; 401/197, 208; 492/13

[56] References Cited

U.S. PATENT DOCUMENTS

| | | | |
|---|---|---|---|
| D. 315,033 | 2/1991 | Carugati | D4/122 |
| D. 336,371 | 6/1993 | Harris | D4/122 |
| 2,743,469 | 5/1956 | Ditch | 401/197 |
| 3,273,192 | 9/1966 | Mazzella | 15/144.1 |
| 3,408,676 | 11/1968 | Cayo | 15/230.11 |
| 3,702,739 | 11/1972 | Rentfrow | 401/197 |
| 3,977,797 | 8/1976 | Paterson | 401/15 |
| 4,089,082 | 5/1978 | McGrew | 15/230.11 |
| 4,528,714 | 7/1985 | Beck | 15/144.1 |
| 4,732,503 | 3/1988 | Bader et al. | 401/197 |
| 5,207,755 | 5/1993 | Ampian | 15/230.11 |
| 5,613,264 | 3/1997 | Knowles | 15/230.11 |

FOREIGN PATENT DOCUMENTS

| | | | |
|---|---|---|---|
| 2901848 A | of 1980 | Germany | B05C 17/02 |
| 3302933 A | of 1983 | Germany | B05C 17/02 |

*Primary Examiner*—Larry I. Schwartz
*Assistant Examiner*—Marc W. Butler
*Attorney, Agent, or Firm*—Faegre & Benson

[57] ABSTRACT

A powered paint roller assembly for delivering paint to the roller through a handle, a tubular connection from the handle to a roller housing which will deliver paint to one end interior of a cylindrical paint roller which roller has a plurality of passages therethrough to allow paint to pass onto the nap of the roller for application to the desired surface. The tubular connection from handle to roller is provided with either a mechanical fluid flow knuckle or a resilient connection, either of which allow the roller to be shifted from a position perpendicular to the handle or parallel thereto or to positions intermediate thereof. The other end of the roller is provided with a removable edger device which prevents paint from being applied outwardly of such other end.

11 Claims, 3 Drawing Sheets

POSITIONABLE POWER PAINT ROLLER WITH EDGER DEVICE

RELATED APPLICATIONS

Applicant has no current applications which relate to the subject matter disclosed herein and is not aware of any applications by others which relate to the matter disclosed herein.

SPONSORSHIP

This invention has not been made under any Federal nor Independent sponsorship.

FIELD OF THE INVENTION

This invention relates generally to roller paint applicators and particularly to those roller applicators that are known as power rollers in which paint is fed, under pressure, to the interior of the roller where it is dispensed through apertures in the roller directly to the roller nap for application to the desired surface. This eliminates the usual constant wetting of the roller surface in a paint storing pan. Also, this invention relates more particularly to a power roller wherein the roller is shiftable from the normal handle-perpendicular position to a handle-parallel position and which also includes a rapidly removable and replaceable edge control which will prevent paint from spreading from the end of the roller onto surfaces that are not to be painted.

SHORT SUMMARY OF THE INVENTION

A power paint roller including a handle which receives paint under pressure and is connected to the interior of a paint roller through a conduit for delivery of paint to the roller where it exits the roller through a plurality of apertures to wet the nap of the roller for application to the desired surface as the roller is moved thereacross.

In a first form of the invention, the conduit includes a flow through knuckle or universal connector which permits shifting of the roller from a position of being perpendicular to the handle to a position of being parallel to the handle while still allowing flow. In this second or parallel position the roller may be used for horizontal strokes while in the perpendicular position it is normally used for vertical strokes.

In a second form of the invention, the knuckle or universal connection is replaced by a flexible connecting line which again allows the roller to be shifted from a handle-perpendicular position to a handle-parallel position. Obviously, in this second form, a support must be provided between the handle and the roller.

In either instance, the paint is fed into one end of the roller and it exits through apertures through the roller to wet the nap of the roller. On the opposite end of the roller a removable, replaceable edge guide is provided to prevent paint from spreading over areas that are not to be painted. This edge guide is not required in all locations but is used when it is not desirable to paint adjacent surfaces such as adjacent walls, ceilings or window or door trim.

BACKGROUND AND OBJECTS OF THE INVENTION

What may be termed a manual roller has long been known in the art. These normally consist of a rotatable mandril carried by a handle with a nap carrying tube slid onto the mandril. These manual rollers are refilled or replenished with paint by rolling them in a paint storage pan. Many of these manual rollers allow for shifting of the roller from a position of being handle-perpendicular to being handle-parallel such that they may be used for vertical or horizontal movement.

These manual rollers were relatively inefficient in their operation as they required the user to continually replenish the roller with paint from a storage pan. As a result of this, pressure rollers were developed and these included means for introducing paint through the handle to the interior of the roller and the methods of introducing the paint to and through the handle included pumps and pressure rods or wands in which the rod or wand was filled with paint by sucking the paint into the rod or wand from supply cans or the like. All of these pressure rollers were arranged in a stationary position wherein the roller was arranged permanently, perpendicular to the handle.

With the applicant's invention, a pressure roller is provided which allows that the roller may be used in either handle-perpendicular position or in handle-parallel position. Such a modification including an arrangement wherein the conduit carrying the paint from the handle to the interior of the roller as well as the roller would be shiftable through at least 90 degrees while maintaining flow therethrough.

Applicant obtains this shiftability in two forms. In a first form, the paint carrying conduit is provided with a midpoint knuckle or universal connector which allows flow therethrough while still supporting the roller structure. In a second form, the carrying conduit is split with the ends of the split conduit being joined by a flexible conduit. In order to maintain roller support in this second form, a mechanical connection is provided between the two ends of the conduit which allows them to be shifted with respect to one another while the flexible connection portion allows for continued flow through such position change.

As the paint enters one end of the roller structure, very often the paint being applied to the wall along the roller and particularly at the other end of the roller will not be in a straight line but will tend to spread. For this reason, the applicant has provided an edger device which is removable and replaceable at such other end. Such an edger will prevent such spreading and this is particularly critical when painting a wall adjacent a ceiling, adjacent another wall, such as in a corner or along trim such as door or window trim.

It is therefore an object of the applicant's invention to provide a power roller which includes a flow conduit between a handle portion and a roller which includes means for displacing conduit sections to allow shifting the roller with respect to the handle.

It is a further object of the applicant's invention to provide a power roller which includes a flow conduit between a handle portion and a roller which includes a universal flow through connector within the conduit to allow shifting of one conduit section with respect to the other conduit section while maintaining paint flow therethrough whereby the roller may be shifted with respect to the handle.

It is still a further object of the applicant's invention to provide a power roller which includes a flow conduit between a handle portion and a roller which flow conduit includes a flexible portion whereby the conduit may be formed to allow shifting of the roller with respect to the handle.

It is still a further object of the applicant's invention to provide a power roller structure which includes a removable and replaceable edge guide on one end thereof to prevent side flow from the roller onto adjacent surfaces which are not to be painted.

These and other objects and advantages of the applicant's invention will more fully appear from a consideration of the accompanying drawings and disclosure.

DESCRIPTION OF PREFERRED FORMS OF THE INVENTION

Figure 1:
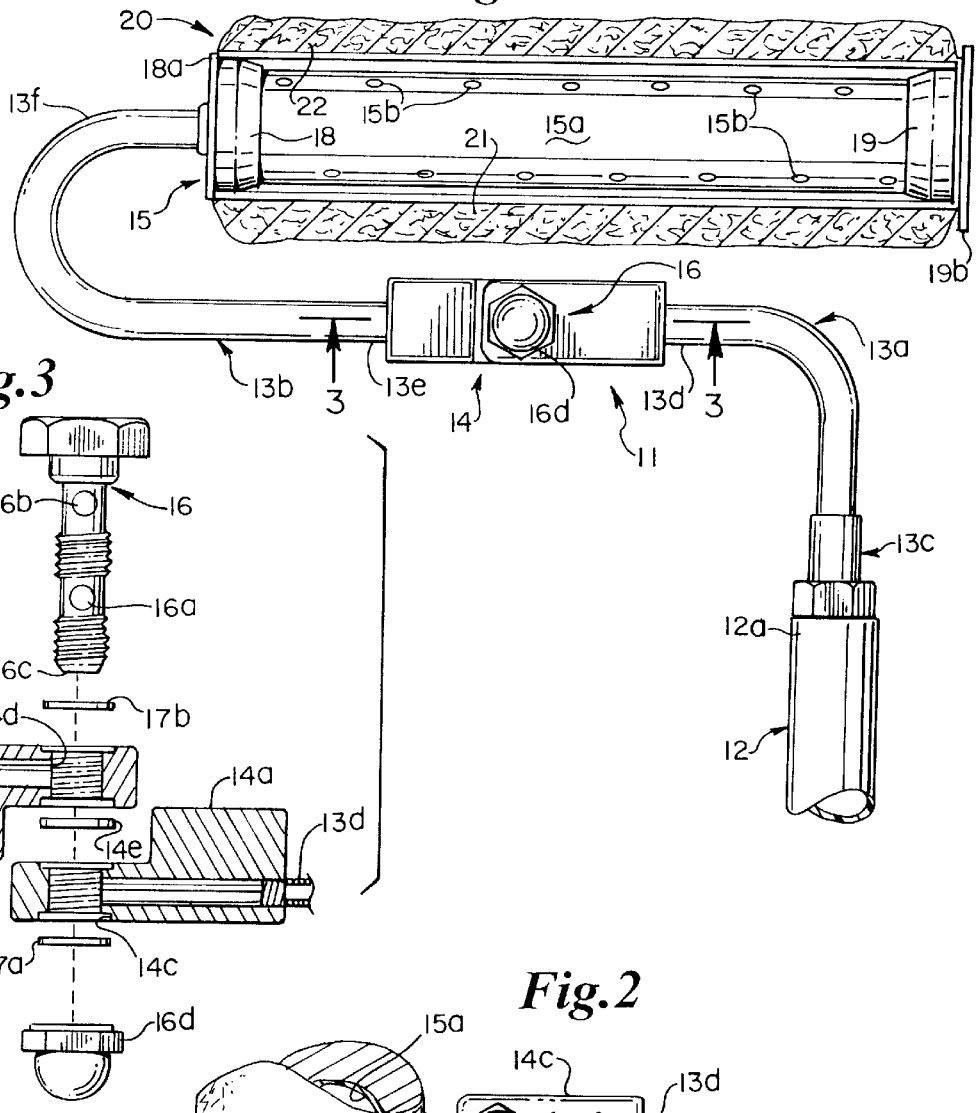
FIG. 1 is a partial section, frontal view of a first form of a power paint roller embodying the concepts of the invention with the roller in a position perpendicular to the handle of the unit.
Figure 3:
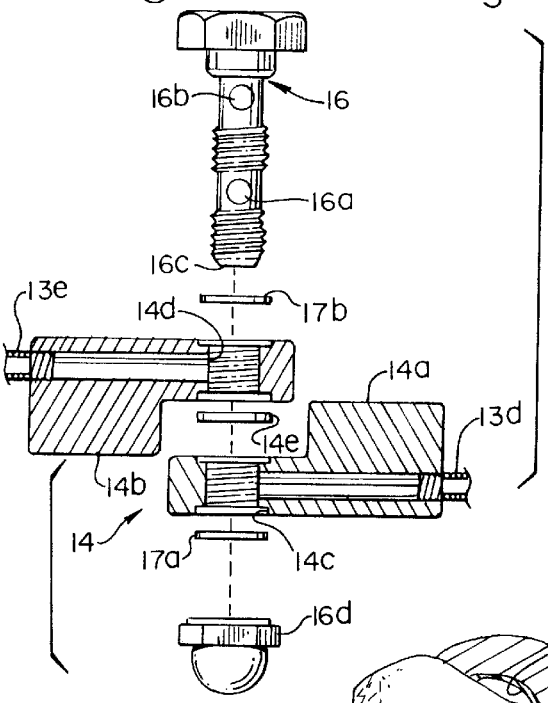
FIG. 3 is an exploded view of the section taken along Line 3—3 of FIG. 1.
Figure 2:
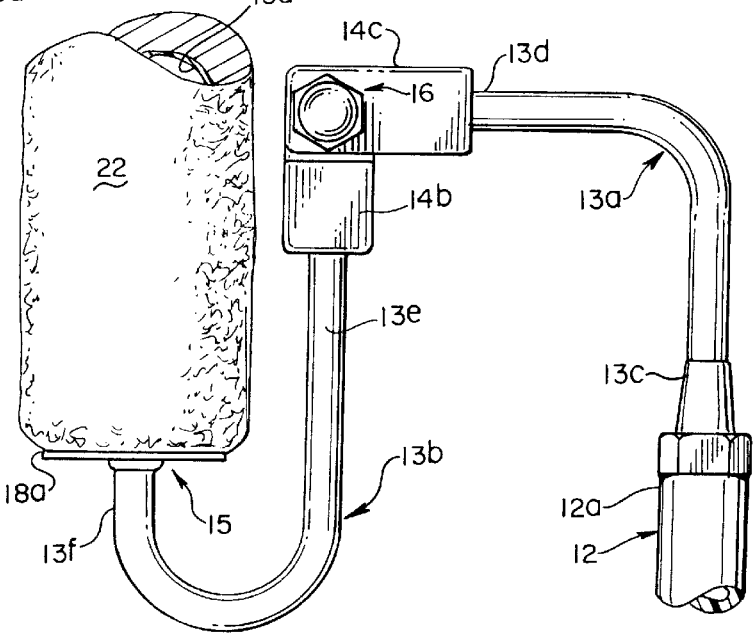
FIG. 2 is a view illustrating the shiftability of the unit of FIG. 1 to place the roller in a position parallel to the handle.

As illustrated in the accompanying drawings and particularly FIGS. 1, 2 and 3, which illustrate a first form of the invention, the entire power roller unit is generally designated 11 and includes a handle 12, a paint flow conduit consisting of conduit sections 13*a*, 13*b* having a knuckle or universal connector 14 arranged and constructed to connect the conduit sections 13*a*, 13*b* and permit them to rotate relative to each other and a roller carrying mandril 15.

Paint under pressure is delivered to the end (not shown) of handle 12 to flow interiorly of the handle 12 for deliver to conduit section 13*a*. Obviously, end 13*c* of section 13*a* is fluidly secured to handle end 12*a* of handle 12. The other end 13*d* of conduit section 13*a* is fluidly sealed to a first hinge block 14*a* of universal connector 14. A first end 13*e* of conduit section 13*b* is fluidly secured to a second hinge block 14*b*. Transverse, threaded, aligned passages 14*c*, 14*d* are provided respectively through the hinge blocks 14*a*, 14*b* and a threaded hinge pin 16 is provided as the joinder element between blocks 14*a*, 14*b*. A compression seal member 14*e* is provided intermediate the hinge blocks 14*a*, 14*b* such that when the hinge pin 16 is inserted and threaded into passages 14*c*, 14*d* a fluid tight but rotatable connection is provided between such blocks 14*a*, 14*b*. For paint to travel from conduit end 13*d* to conduit end 13*e*, a pair of transverse passages 16*a*, 16*b* are provided through hinge pin 16 and similarly hinge pin 16 is longitudinally bored or drilled as from end 16*c* to join the transverse passages 16*a*, 16*b*. Obviously, transverse passages 16*a*, 16*b* must respectively align with conduit ends 13*d*, 13*e* for fluid flow. As hinge pin 16 is longitudinally bored or drilled from end 16*c* a closure cap 16*d* must be provided to seal such longitudinal passage. Lock washers or the like 17*a*, 17*b* may be provided.

With this hinge block or universal connector 14 it should be obvious that the conduit sections 13*a*, 13*b* may be shifted and rotated with respect to one another to the position as illustrated in FIG. 2 wherein the roller carrying mandril 15 is arranged in a position parallel to the handle 12 while maintaining paint flow therethrough.

In the position of FIG. 1 the use of the roller will be for vertical rolling and application while in the position of FIG. 2, the roller will be used for horizontal application.

The end 13*e* of second conduit section 13*b* delivers paint under pressure to the interior of mandril 15. Mandril 15 includes a longitudinally extending, generally cylindrical body 15*a* of a first diameter with a plurality of paint release apertures 15*b* formed therethrough for the release of paint to the interior of a napped roller 20. The napped roller 20 includes a core 21, normally perforate but definitely paint passing for wetting of the nap 22 carried on the core 21. The mandril 15 includes a pair of enlarged shoulders 18, 19 to accommodate and carry the roller core 21.

The shoulder 18 includes means for rotatably mounting the same to the conduit end 13*f* to permit the mandril and carried roller 20 to rotate as they are rolled across a surface for proper application of paint thereto. A radial stop 18*a* may be provided on enlarged shoulder 18 to provide a stop against which the roller core 21 is positioned. An edger member 19*b* may be provided on the enlarged shoulder 19 of mandril 15 and the edger or edgers will be discussed and disclosed hereinafter. Obviously, to place the roller 20 onto the mandril 15, the edger device 19*b* is removed from the mandril shoulder 19 and as will be explained hereinafter the edger device is normally not used except when required such as along adjacent walls, ceilings, trim and other areas not to be painted. The roller core 20 is of a size with respect to the enlarged mandril shoulders 18, 19 that it is held thereon by friction.

The operation of the unit should be obvious to anyone skilled in the art. Paint under pressure is delivered through handle 12, through the conduit sections 13*a*, 13*b* and universal block 14, in either of the roller-handle positions of FIG. 1 or FIG. 2, to the interior of the mandril 15 where it is displaced to the interior core 21 of the roller 20 for delivery to the nap 22 of the roller for application to a wall or other surface.

Figure 4:
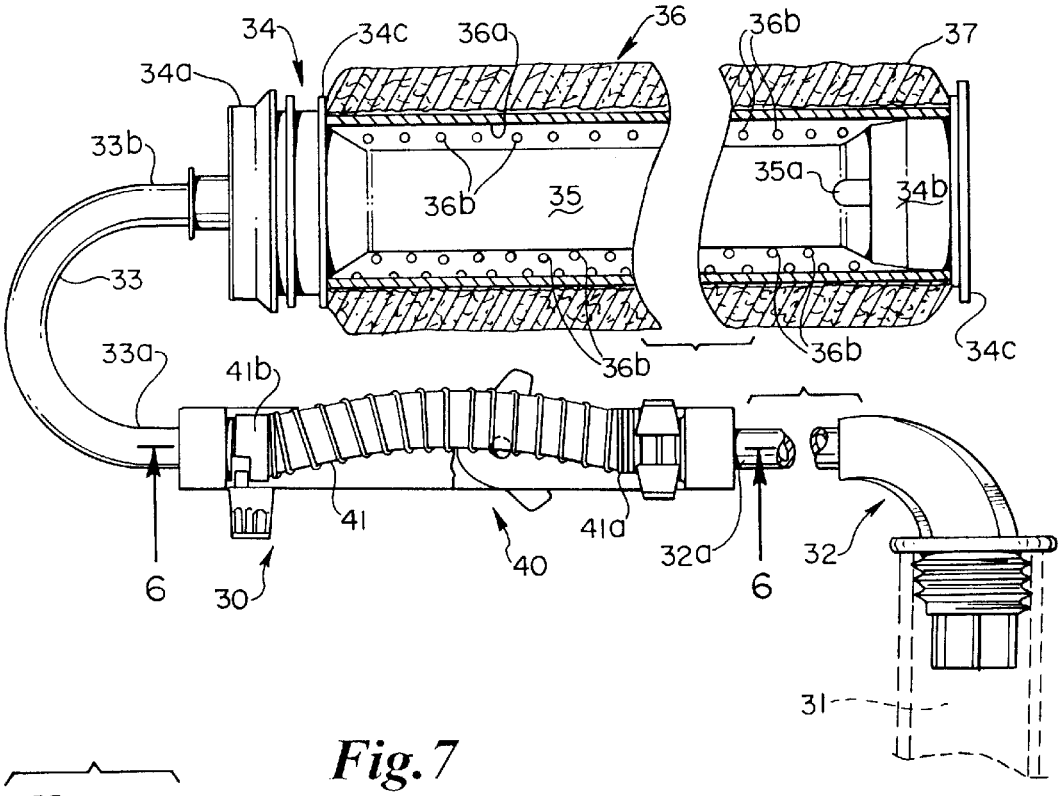
FIG. 4 is a partial section, frontal view of a second form of a power paint roller embodying the concepts of the invention with the roller in a position perpendicular to the handle.
Figure 5:
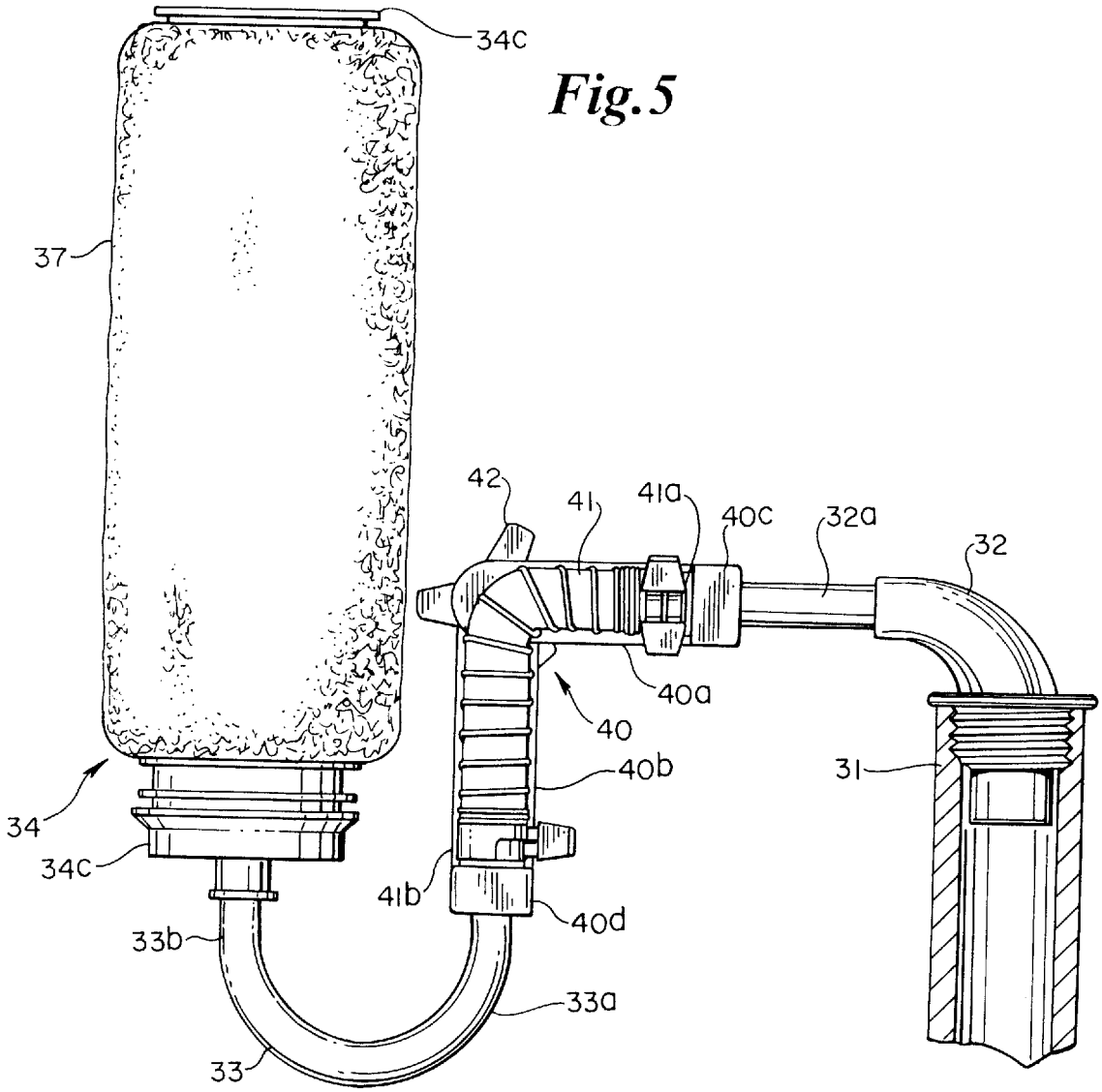
FIG. 5 is a view illustrating the shiftability of the unit of FIG. 4 to place the roller in a position parallel to the handle.
Figure 6:
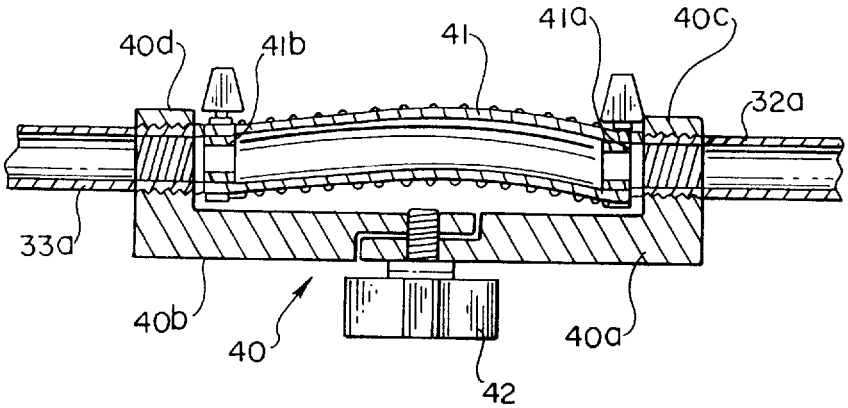
FIG. 6 is a cross section taken substantially along Line 6—6 of FIG. 4.

A second form of the invention is illustrated in FIGS. 4, 5 and 6 the operation of which is identical to the first form of the invention but which includes a modified from of universal connector between conduit sections which will be less expensive to manufacture and, perhaps, require less maintenance and adjustment than the first form.

In this second form, the entire unit is designated generally 30 and includes a handle 31, having an end (not shown) to which a source of paint under pressure may be connected, a first delivery conduit 32 secured to handle 31, a second delivery conduit 33 rotatably connected to a roller carrying mandril 34. Intermediate conduit sections 32, 33 is a flexible connector unit generally designated 40 which will flexibly connect the ends 32*a*, 33*a* of conduits 32, 33. As comparatively illustrated in FIGS. 4 and 5, the purpose of this flexible connector 40 is to permit the offsetting of the roller carrying mandril 34 ninety degrees such that it is shiftable from a position of handle-perpendicular as shown in FIG. 4 to handle-parallel in FIG. 5.

The flexible connector 40 includes a flexible, tubular member 41 having a first end 41*a* thereof secured to end 32*a* of conduit 32 and a second end 41*b* secured to end 33*a* of conduit 33. As particularly illustrated in FIG. 6, the connector 40 includes a rotatable, shiftable mounting structure including a first mounting section 40*a* and a second mounting section 40*b*. Each of these sections 40*a*, 40*b* include respective upwardly directed clamping or securing members

40*c*, 40*d* receiving and securing conduit end sections 32*a*, 33*a*. Central of said connector 40 is a locking device shown as a threaded hand operable bolt received into passages in the mounting sections 40*a*, 40*b* to release and lock the same to permit relative rotation therebetween and permit shifting of the roller carrying mandril between the positions illustrated in FIGS. 4 and 5.

The delivery end 33*b* of conduit 33 is rotatably secured to a first mandril shoulder 34*a*. This shoulder 34*a* is illustrated in a form varied from the enlarged mandril shoulders of the first form of the invention solely to illustrate that various roller carrying mandrels do exists and this invention is not limited to a particular type of roller carrying mandril.

The mandril 34 consists of this first shoulder 34*a*, a longitudinally extending body section 35 having at least one paint outlet 35*a* at the end thereof and which may include a plurality of such outlets spaced circumferentially about body 35 and a second enlarged shoulder 34*b*. The roller 36, in this illustrated form includes a support core 36*a* having a plurality of perforations 36*b* to allow the paint to flow therethrough to wet the nap 37 of the roller 36. The roller core 36*a* and thus the carried nap 37 is frictionally carried on the ends 34*a*, 34*b* of the mandril 34 and may abut stop 34*c* on one end thereof.

With particular reference to the mandril 34 and roller 36 illustrated in FIG. 4, paint will flow through the interior of the mandril body 35 to the exit opening or openings 35*a* to flow rearwardly (to the left) and radially outwardly through passages 36*b* to wet the roller nap 37. An edger device 34*c* may be provided at the outboard end of enlarged mandril shoulder 34*b* and this will be described hereinafter along with a description of edger device 19*b* shown in FIG. 1 of the first form illustrations. Again, as stated in the description of the first form of the invention, this edger 34*c* is not always in use.

The operation of this form of the invention is identical to that of the first form of the invention. Paint under pressure is delivered from a source, through handle 31 into conduit 32, through the connector element 40, regardless of its position with respect to the handle 31, into conduit section 33 and ultimately to the interior of body 35 of mandril 34 where it is delivered to the roller core 36*a* through outlets 35*a* to exit therefrom to wet the nap 37 of the roller 36.

Figure 7:
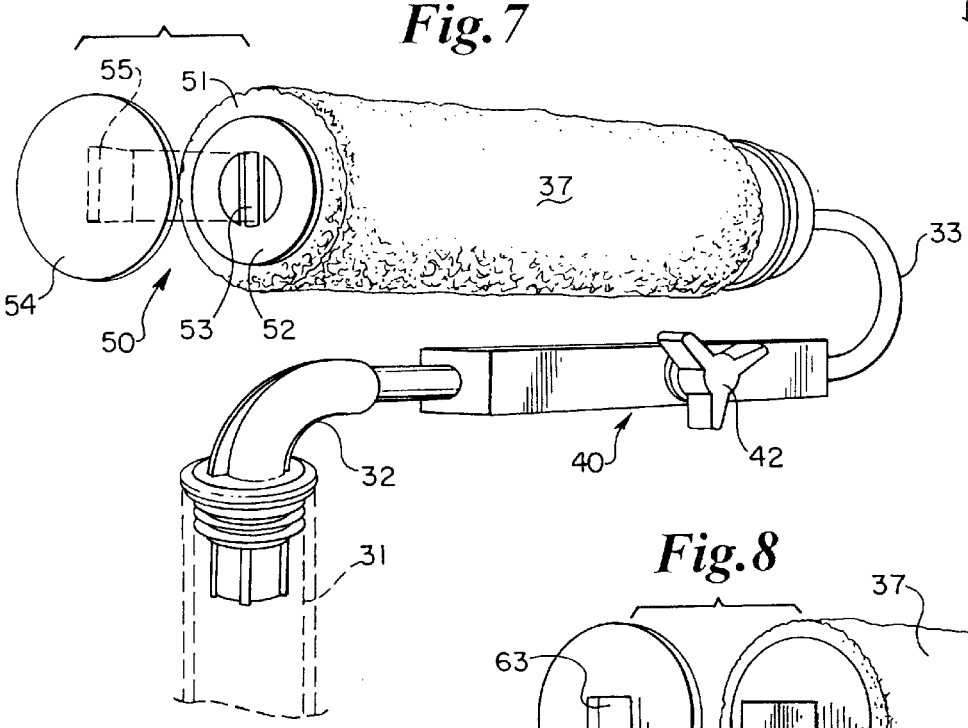
FIG. 7 is a perspective view of one form of the unit particularly illustrating one form of edger device which is useable on either form of the units; and, FIG. 8 is a view illustrating a second form of edger device.
Figure 8:
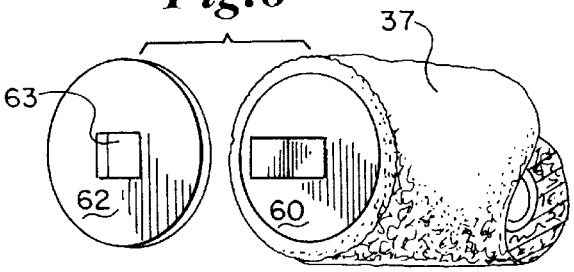

Two forms of removable, replaceable edger units are shown respectively in FIGS. 7 and 8. Although applicable to any form of roller, elements of the second form of the invention including handle 31, conduits 32, 33, connector element 40 and setting bolt 42 along with a roller nap section 37 are illustrated.

In the first, female form of the edger device, now generally designated 50 includes an enlarged roller holding shoulder 51 and generally flat plate end 52. Arranged generally centrally of the plate 52 is a diametrically arranged, inwardly directed slot 53. The actual edge performing structure includes a generally circular plate 54 having a rectangular male member 55 on one side thereof which male member 55 is receivable and removable from slot 53. The diameter of plate 54 is provided in relation to the total diameter of the roller, including nap, 37 that is being used. Applicant has found that the diameter of the edger plate 54 should be slightly less than the total diameter of the roller as, when the roller is in use, it is pressed against a surface and the nap will compress. If the edger plate 54 were of a diameter, even equal to the diameter of the roller, it would not allow the paint to be properly applied.

The second form of edger is illustrated in FIG. 8. In this form, the enlarged roller retaining shoulder 60 is provided with a generally rectangular male extension 61 and the actual edger plate 62 includes a generally rectangular opening 63 therein.

With either form of edger device, it should be obvious that the edger 54, 62 is easily removable and replaceable to the end of the roller. Anyone that has painted a wall knows that it is often necessary to "cut-in" around adjacent walls, ceilings, wood trim and the like as a standard roller without an edger device cannot be used in such areas without having some of the paint from the end of the roller "spill over" onto such areas. Then again, it is not necessary to use the edger device over the general area of the surface to be covered and it will normally be removed when working over such areas.

The use of applicant's devices for shifting the attitude of the roller with respect to the handle has been explained and it should be obvious that there are distinct advantages with this shifting ability in that, in effect, a dual purpose tool is provided.

What is claimed is:

1. A positionable power paint roller comprising:

a) a roller carrying mandril having two ends;

b) a handle having a first end arranged and constructed to receive paint under pressure and allow paint to flow therethrough;

c) a transfer conduit arranged on the second end of said handle to receive paint from said handle and deliver the same to one end of said roller carrying mandril;

d) conduit dividing means provided in said conduit dividing said conduit into at least two sections, a first section being secured to and receiving paint from said handle, a second section arranged to deliver paint to said roller carrying mandril; and said first section and said handle positionable to bring said roller carrying mandril into a position in a range between generally parallel to said handle and a position perpendicular to said handle, said conduit dividing means further including i) a connector having a hinging means, with a first portion on the first section of the conduit and a second portion on the second section of the conduit, ii) a hinge coupling means receivable into said first and second portions of said connector permitting relative rotation between said sections, wherein said hinge coupling means provides a flow passage therethrough to receive paint under pressure from said first section and transfer such paint to said second section for delivery of paint to the roller mandril;

said conduit dividing means further permitting displacement of said second section of said conduit to said first section of said conduit such that said second section may be shifted with respect to said handle.

2. The positionable power roller as set forth in claim 1 further comprising seal means intermediate said first and second portions of said connector.

3. The positionable power roller as set forth in claim 2 wherein said hinge coupling means comprises:

i) a longitudinally extending member having a threaded portion; and ii) a threaded engaging member receivable on said extending member such that tightening of said engaging member provides sealing pressure upon said seal means while permitting relative rotation between said conduit sections.

4. The positionable power roller as set forth in claim 1 wherein said conduit dividing means comprises a flexible conduit section interposed between the ends of said first and second conduit sections such that said second section may be shifted relative to said first section to bring said roller carrying mandril into a position in a range between generally perpendicular and generally parallel to said handle.

5. The positionable power roller as set forth in claim 4 wherein said first and second portions of said connector of said conduit dividing means further comprises:

i) a first clamp block secured to the end of said first conduit section;

ii) a second clamp block secured to the end of the second conduit section; and wherein said first and second clamp blocks are pivotally joined to provide support between said first and second conduit sections while permitting relative motion therebetween.

6. The positionable power roller as set forth in claim 1 wherein said roller carrying mandril further comprises a female opening on the other end thereof and the positionable power roller further comprises:

f) a generally circular plate member having a male extension on one side thereof removably receivable into said female opening for abutment against an adjacent end of a roller provided on said roller carrying mandril to prevent paint from being delivered therepast.

7. The positionable power roller as set forth in claim 6 wherein said female opening includes a diametrically arranged slot and said male extension provides a diametrically arranged body of a size to be removably received into said slot.

8. The positionable power roller as set forth in claim 6 wherein the diameter of said circular plate is slightly less than the diameter of the roller received upon said roller carrying mandril.

9. The positionable power roller as set forth in claim 1 wherein said roller carrying mandril further comprises a male extension on the other end thereof, and the positionable power roller further comprises:

f) a generally circular plate member having a female opening removably positionable on said male extension for abutment against an adjacent end of a roller provided on said roller carrying mandril to prevent paint from being delivered therepast.

10. The positionable power roller as set forth in claim 9 wherein said male extension includes a generally rectangular member and said female opening includes a generally rectangular opening removably receivable about said male member.

11. The positionable power roller as set forth in claim 10 wherein the diameter of said circular plate is slightly less than the diameter of the roller received upon said roller carrying mandril.

* * * * *